US006203346B1

(12) United States Patent
Wu et al.

(10) Patent No.: US 6,203,346 B1
(45) Date of Patent: Mar. 20, 2001

(54) ELECTRICAL CONNECTOR

(75) Inventors: Ming Chuan Wu, Shun-Lin; Da Ching Lee, Tai-Chung, both of (TW)

(73) Assignee: Hon Hai Precision Ind. Co., Ltd., Taipei Hsein (TW)

( * ) Notice: Subject to any disclaimer, the term of this patent is extended or adjusted under 35 U.S.C. 154(b) by 0 days.

(21) Appl. No.: 09/439,842

(22) Filed: Nov. 12, 1999

(30) Foreign Application Priority Data

Jul. 27, 1999 (TW) ..... 88212604

(51) Int. Cl.[7] ..... H01R 13/15
(52) U.S. Cl. ..... 439/260; 439/497; 439/610
(58) Field of Search ..... 439/260, 267, 439/495, 492, 497, 610, 329, 67, 77

(56) References Cited

U.S. PATENT DOCUMENTS 6,015,310 * 1/2000 Tojo ..... 439/260
6,036,520 * 1/2000 Tojo ..... 439/260

* cited by examiner

*Primary Examiner*—Gary F. Paumen
(74) *Attorney, Agent, or Firm*—Wei Te Chung

(57) ABSTRACT

A flexible cable connector comprises an insulative housing, a plurality of terminals retained in the housing, and a conductive shield partially surrounding the housing. A plurality of passageways is defined in the housing for receiving the terminals. Each terminal has a terminal member and a contact member for engaging with a mating connector. The flexible cable is inserted into the housing from a rear end thereof and a signal pattern of the flexible cable is adapted to engage with the terminal members of the terminals. The shield slidably covers the housing and forms a pressing plate to engage with a grounding pattern of the flexible cable.

1 Claim, 7 Drawing Sheets

ELECTRICAL CONNECTOR

BACKGROUND OF THE INVENTION

The present invention relates to an electrical connector, and especially to an electrical connector for connecting with a flexible printed circuit (hereafter, "FPC") the connector having a simple structure and a reduced number of components for facilitating automatic manufacture thereof.

An electrical connector for connection with a FPC usually comprises an insulative housing and a shield adapted to surround the housing. A plurality of terminals is mounted in the housing proximate a mating face thereof. The FPC is inserted into the housing from a mounting face of the housing opposite the mating face to contact the terminals. A pressing member is pivotally mounted to the housing proximate the mounting face for being rotated to press against the FPC thereby securing the FPC within the housing. Pertinent prior art is disclosed in U.S. Pat. Nos. 5,370,552; 5,401,186; 5,474,468; 5,580,272; and 5,738,545, and Taiwan Patent Application No. 84218005.

Referring to FIGS. 6 and 7, a conventional electrical connector 6 for connection with an FPC 7 comprises an insulative housing 60 and a first conductive shield 62 adapted to partially surround the housing 60. A plurality of passageways 602 is defined through the housing 60 for receiving corresponding terminals 61 therein. Each terminal 61 includes a contact portion 612 and a terminal portion 614 opposite the contact portions 612. The FPC 7 is inserted into the housing 60 from a rear surface thereof and a signal pattern 70 of the FPC 7 contacts the terminal portions 614 of the terminals 61. A pressing member 63 is pivotally mounted to the housing 60 proximate the rear surface. A second shielding shield 64 surrounds the pressing member 63. The pressing member 63 is rotated to press against the FPC 7 around an axis X thereby securing the FPC 7 within the housing 60 and providing a reliable engagement between the signal pattern of the FPC 7 and the terminal portions 614. Simultaneously, the second shield 64 contacts a grounding pattern 72 of the FPC 7.

Due to current trends, different components of a device are often manufactured at different plants. The components are then transported to an assembly plant to complete assembly of the device. Thus, a structure of each component must be suitable for long distance transportation. The conventional connector 6, before it is assembled with the FPC 7, the second shield 64 and the pressing member 63 thereof, due to their pivotal nature, may be damaged by colliding with other parts of the connector 6 or with unexpected objects outside the connector 6 during transportation. Furthermore, the pressing member 63 and the second shield 64 have a complex structure thereby making manufacture both time and cost inefficient and hindering automatic manufacture. Finally, the conventional connector 6 needs two separate shields 62, 64 to achieve the shielding thereof.

SUMMARY OF THE INVENTION

Accordingly, an object of the present invention is to provide an electrical connector for connection with a flexible cable having a reduced number of components which facilitates automatic manufacture.

To fulfill the above-mentioned object, an electrical connector for connection with a flexible cable comprises an insulative housing, a plurality of terminals retained in the housing and a conductive shield partially surrounding the housing. A plurality of passageways is defined between a front surface and a rear surface of the housing for receiving the terminals. Each terminal has a terminal member and a contact member for engaging with a mating connector. The flexible cable is inserted into the housing from the rear surface and a signal pattern of the flexible cable is adapted to engage with the terminal members of the terminals. The shield is slidable relative to the housing and forms a pressing plate adapted for engaging with a grounding pattern of the flexible cable.

Other objects, advantages and novel features of the invention will become more apparent from the following detailed description when taken in conjunction with the accompanying drawings.

DETAILED DESCRIPTION OF A PREFERRED EMBODIMENT

Figure 1:
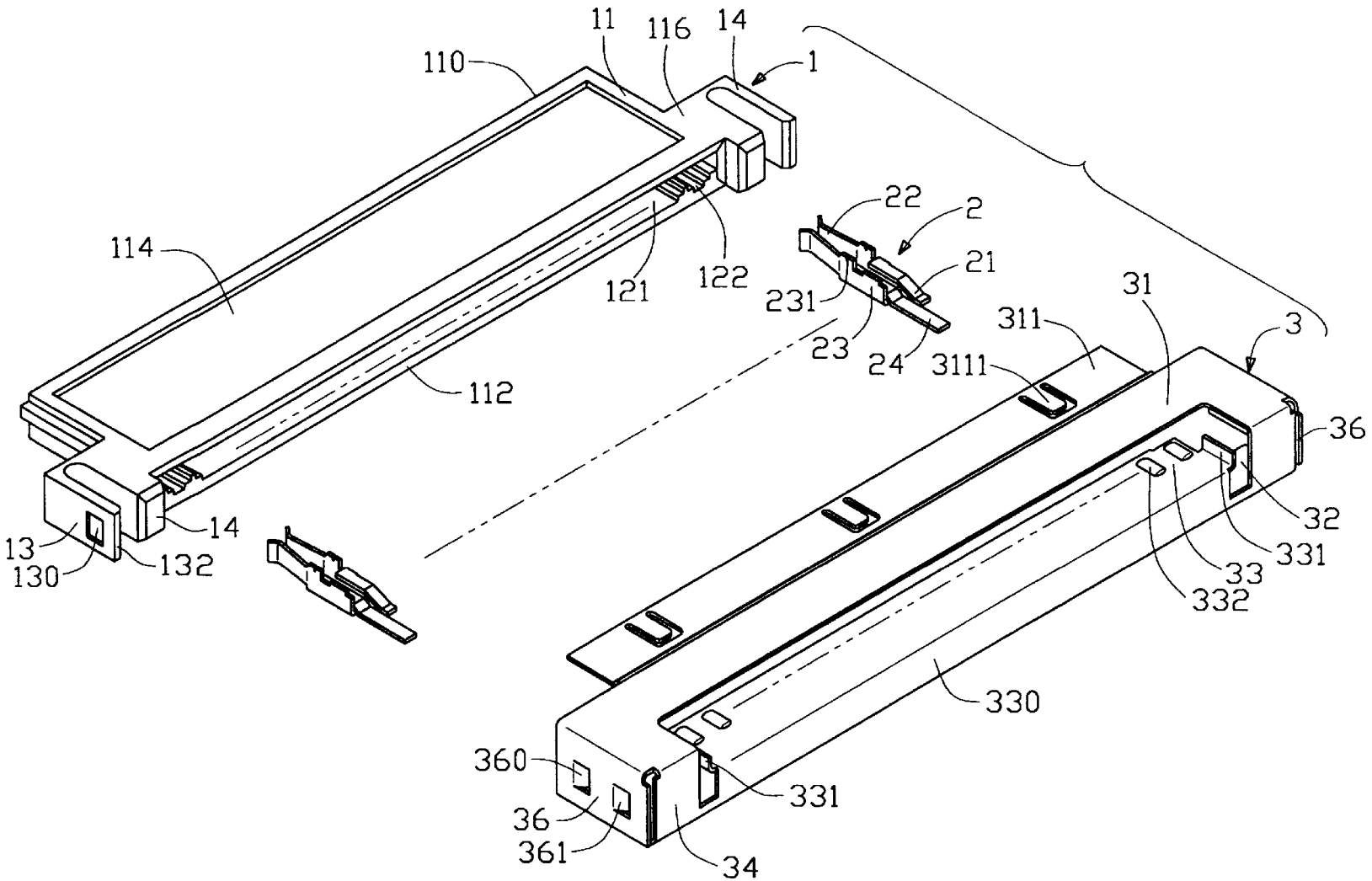
FIG. 1 is an exploded view of an electrical connector for connecting with a FPC in accordance with the present invention.
Figure 2:
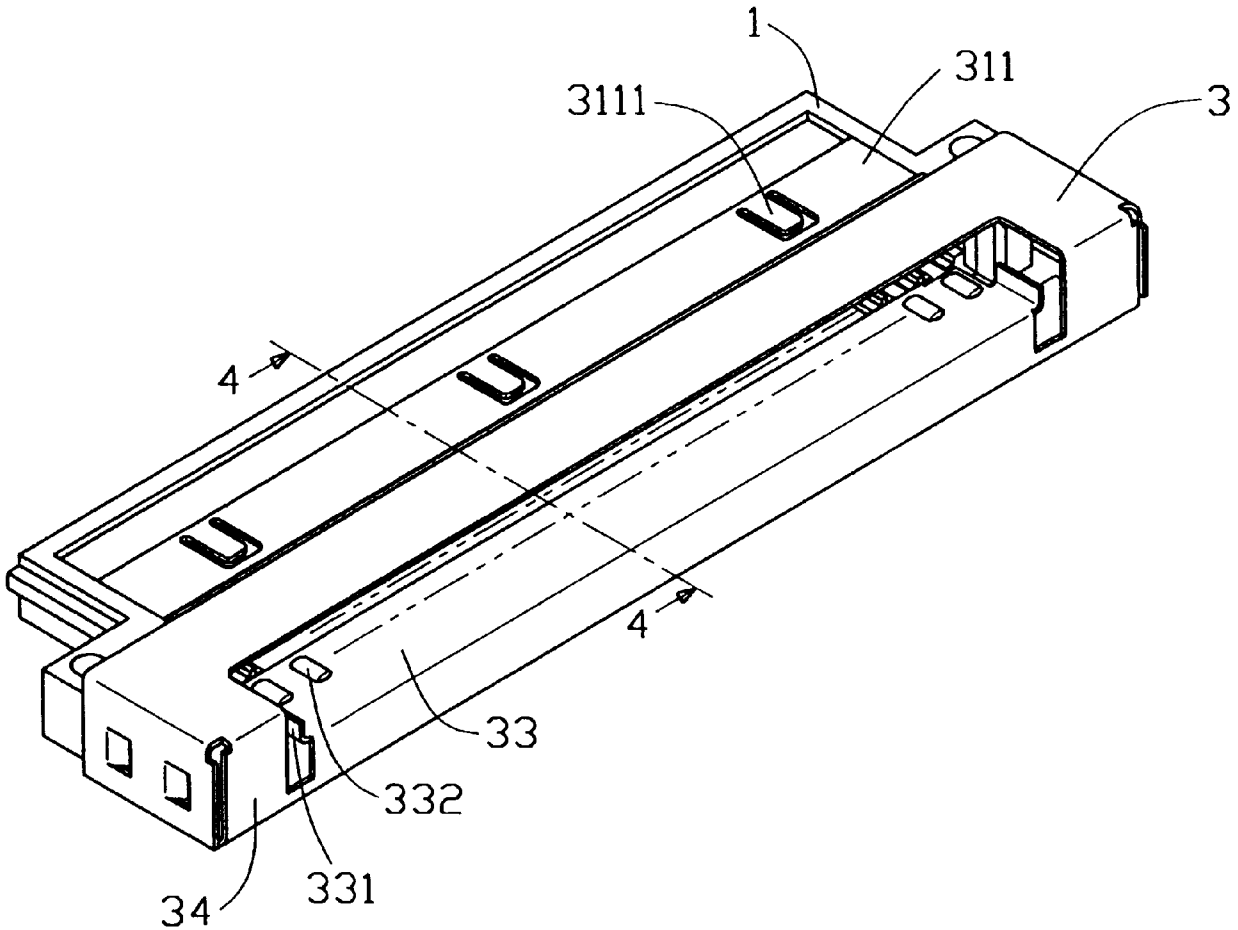
FIG. 2 is a perspective view of the connector of FIG. 1, wherein terminals are mounted in a housing of the connector and a shield is semi-assembled to the housing.
Figure 3:
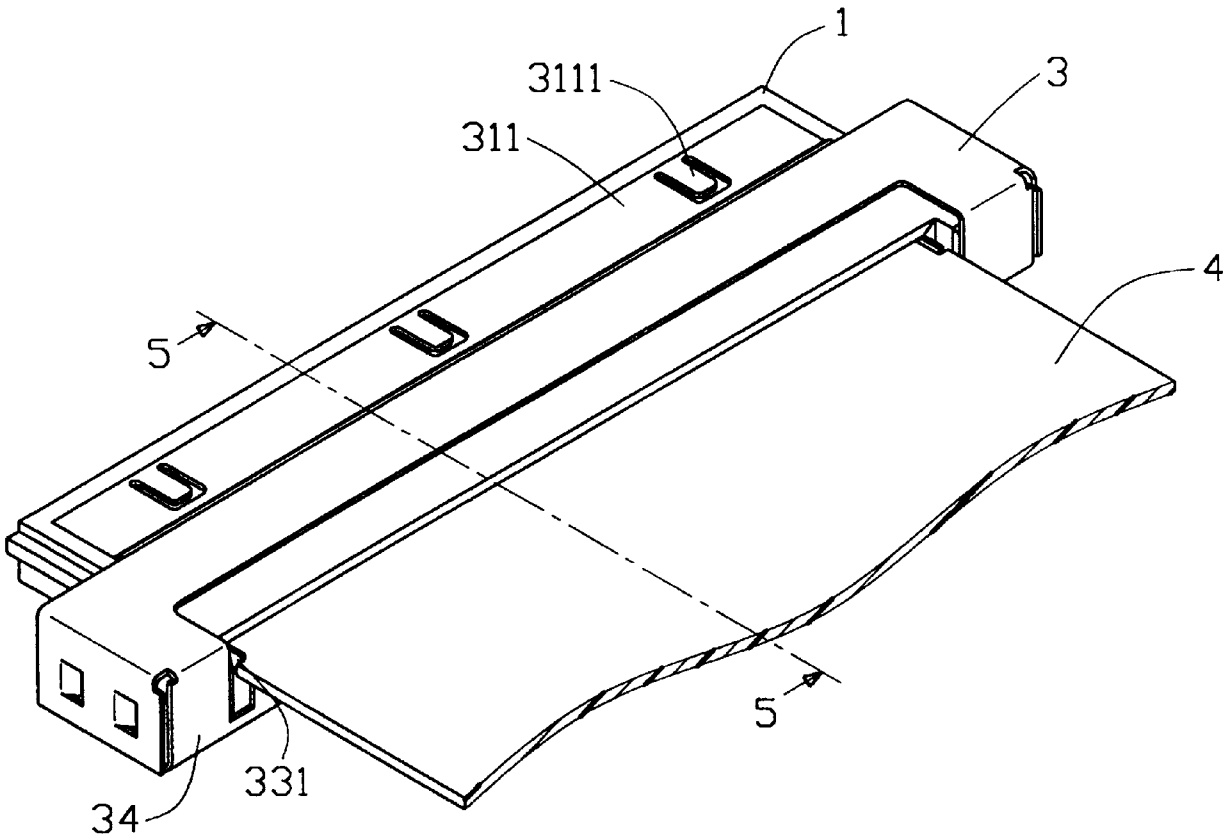
FIG. 3 is an assembled view of FIG. 1, wherein a FPC is inserted into the electrical connector.

Referring to FIGS. 1 and 2, an electrical connector in accordance with the present invention comprises an insulative housing 1, a plurality of terminals 2 retained in the housing 1, and a shield 3.

The housing 1 includes a forwardly extending mating projection 11. The housing 1 has a front surface 110 for mating with a complementary connector (not shown) and a rear surface 112. A plurality of passageways 12 (FIGS. 4 and 5) is defined between the front surface 110 and the rear surface 112 for receiving the terminals 2. Each passageway 12 has a channel with a stepped section 122 for reliably retaining the terminals 2 in the passageway 12. An elongate slot 121 is defined in the rear surface 112 in communication with the passageways 12. A shallow area 114 is defined in a top surface 116 of the housing 11. A pair of protrusions 14 is formed at opposite ends of the housing 1. An L-shaped spring beam 13 is formed by each protrusion 14. Each beam 13 defines a fixing recess 130.

Figure 5:
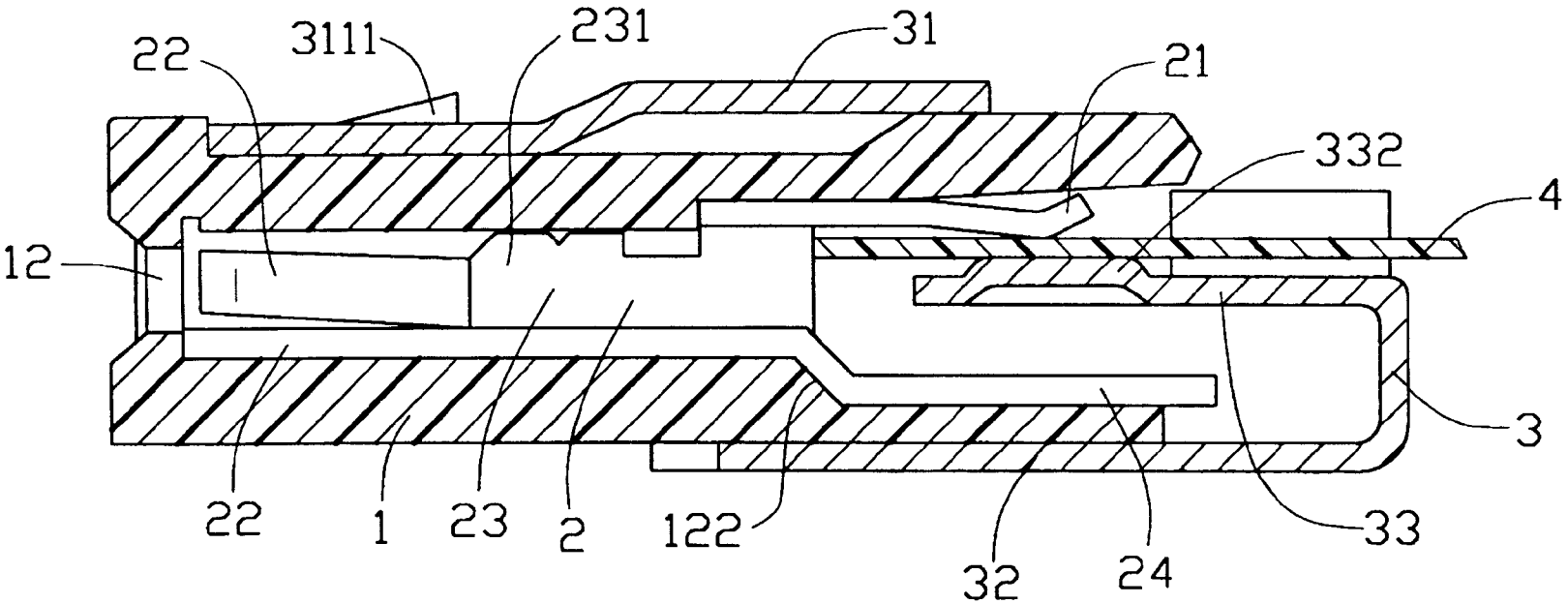
FIG. 5 is a cross-sectional view taken alone line 5—5 of FIG. 3.
Figure 6:
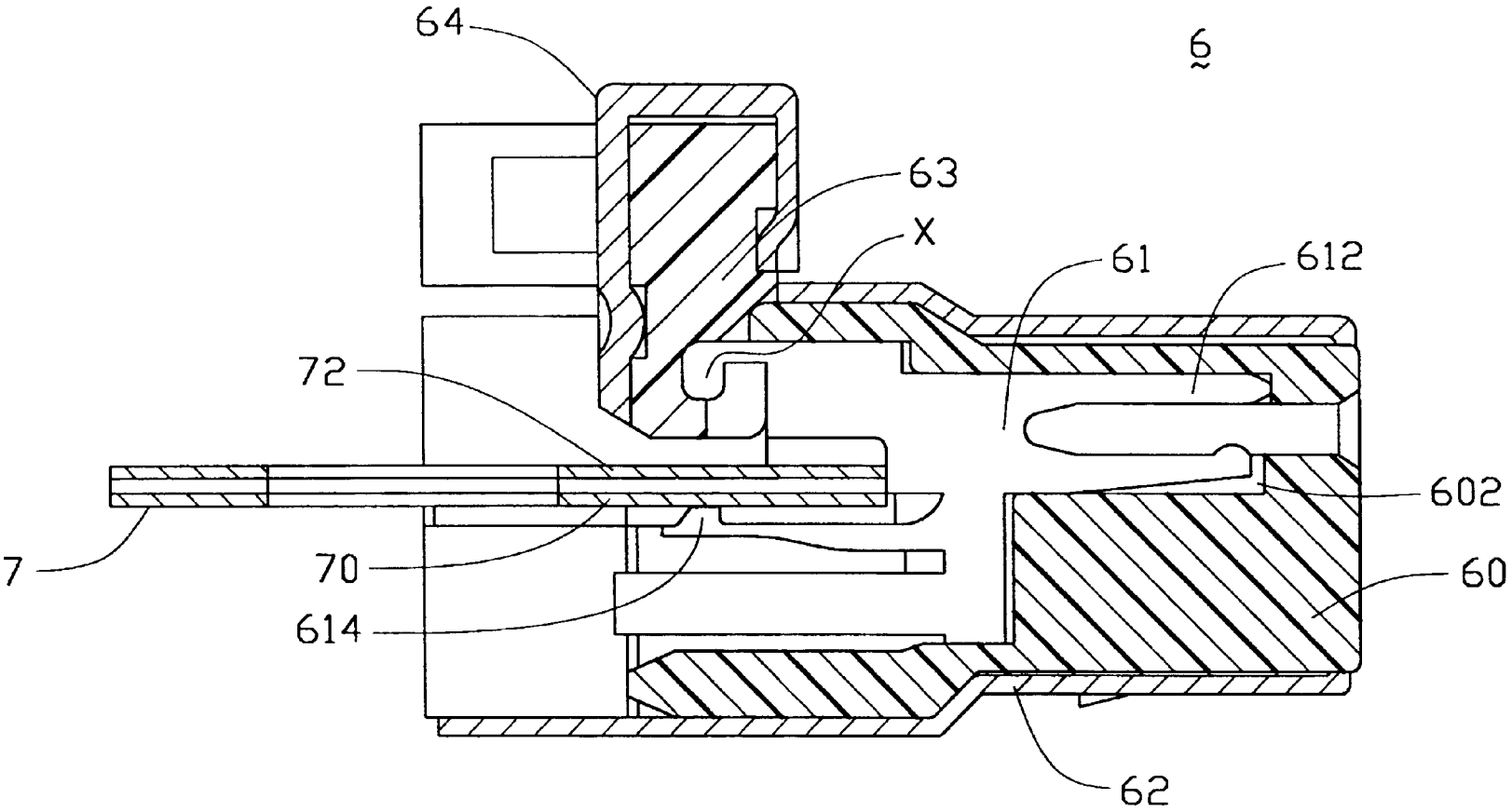
FIG. 6 (PRIOR ART)
FIG. 6 is a cross-sectional view of a conventional electrical connector before completing an assembly with an FPC.
Figure 7:
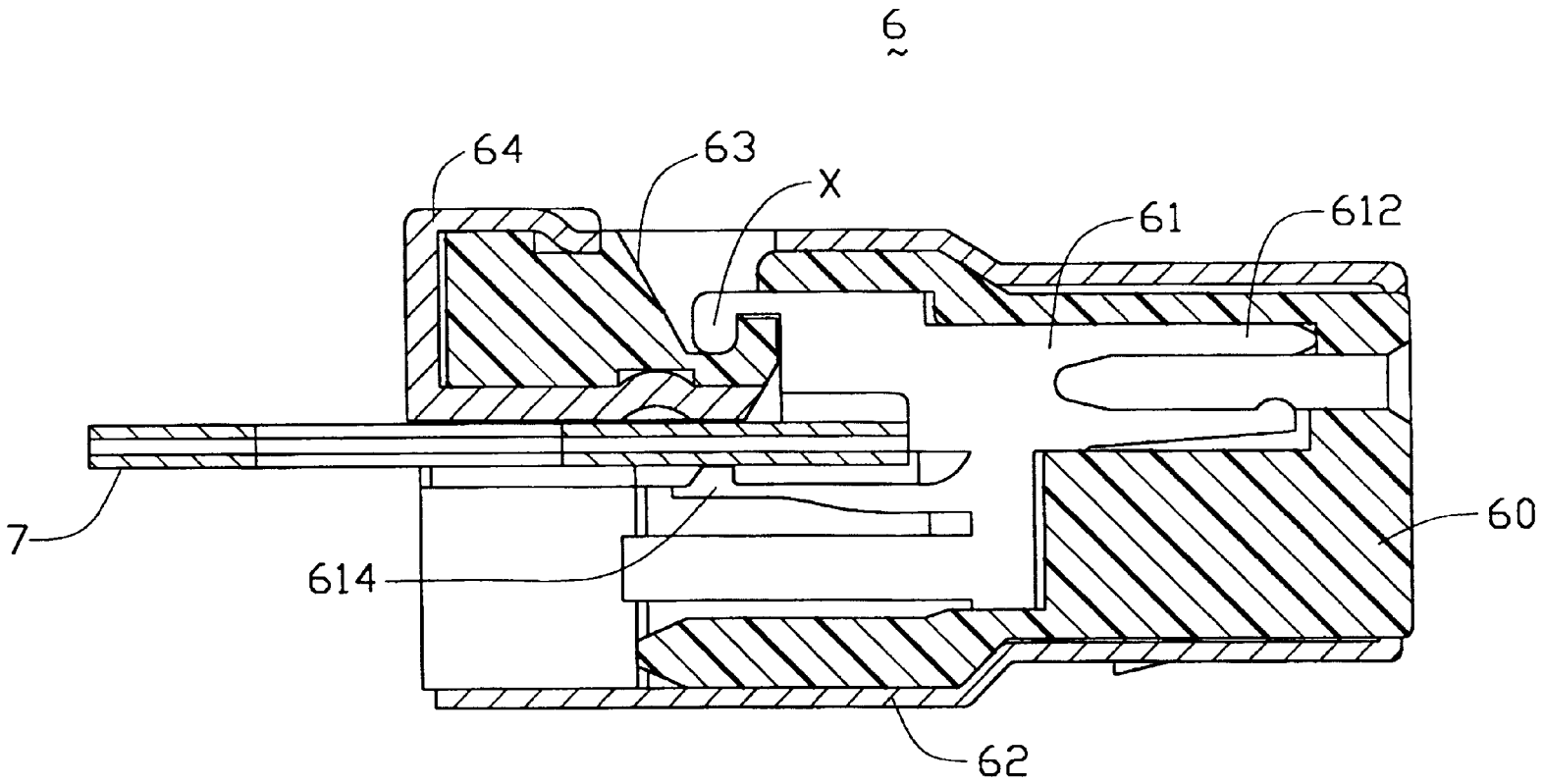
FIG. 7 (PRIOR ART)
FIG. 7 is similar to FIG. 6 showing a pressing member being rotated to press against the FPC to complete the assembly.

Also referring to FIG. 5, each terminal 2 is unitarily stamped to include three contact strips 22 at one end thereof, first and second terminal strips 21, 24 at the other end thereof, and a center portion 23 between the contact strips 22 and the terminal strips 21, 24. Locking barbs 231 are formed on edges of the center portion 23 for being interferentially fit in the corresponding passageway 12. The first terminal strip 21 is shorter than the second terminal strip 24 and has a curved end bent toward the second terminal strip 24.

Figure 4:
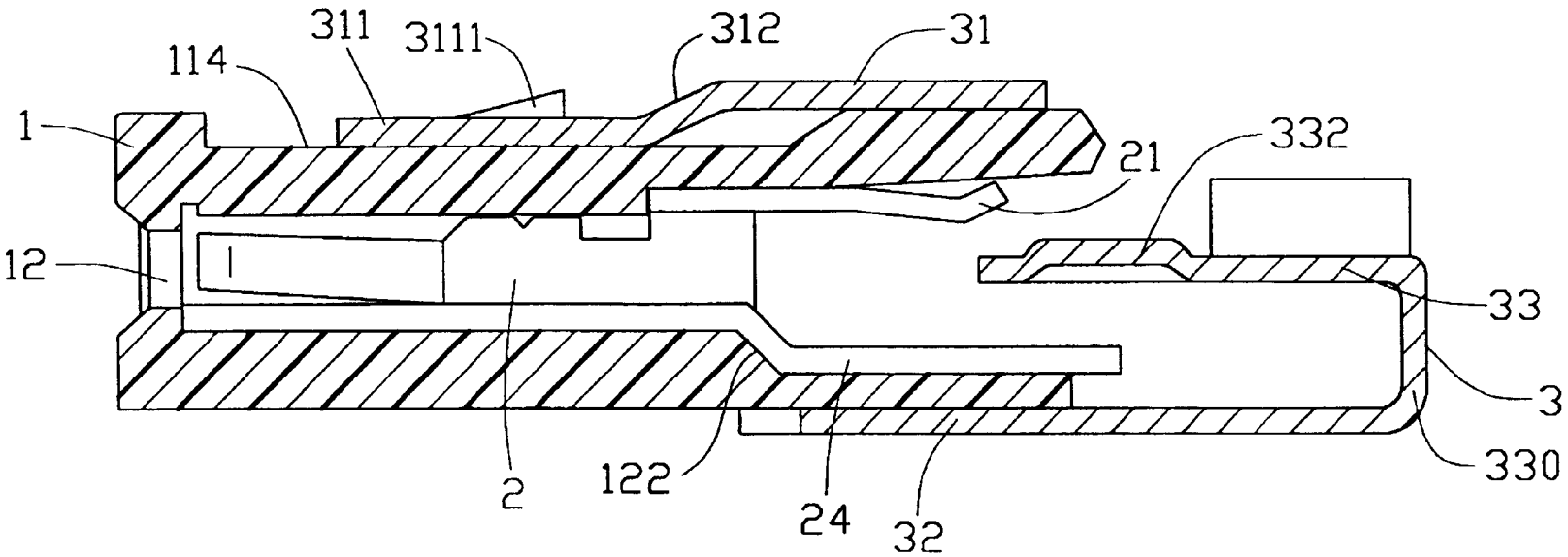
FIG. 4 is a cross-sectional view taken alone line 4—4 of FIG. 2.

Also referring to FIG. 4, the shield 3 is unitarily stamped to include a top wall 31, a bottom wall 32, and a pair of lateral walls 36 for cooperatively defining a space therebetween to accommodate the housing 1. The top wall 31 is adapted to cover the top surface 116 of the housing 1. The lateral walls 36 downwardly extend from opposite ends of the top wall 31 and are adapted to cover the beams 13 of the housing 1. Each lateral wall 36 forms a first inwardly stamped tang 360 and a second inwardly stamped tang 361 corresponding to the fixing recess 130. The bottom wall 32 is adapted to cover a bottom surface of the housing 1 and connects with the top wall 31 via a pair of rear walls 34 which covers a rear face of the protrusions 14 of the housing 1. The shield 3 includes an elongate fixing plate 311 parallel to the top wall 31 and connecting with the top wall 31 via an inclined transition portion 312 (FIGS. 4 and 5). Three parallelly spaced and upwardly stamped lances 3111 are formed in the fixing plate 311. The shield 3 includes an elongate pressing plate 33 substantially parallel to the bottom wall 32 and forwardly extending from a top edge of a vertical wall 330 which is connected to a rear edge of the bottom wall 32. A plurality of bosses 332 is arranged on the pressing plate 33 and parallel to each other. A pair of tabs 331 upwardly extends from opposite ends of the pressing plate 33.

Also referring to FIGS. 2 and 4, in assembly, the terminals 2 are received in the corresponding passageways 12 from the rear surface 112. The housing 1 is then inserted into the shield 3 so that the top wall 31 covers the top surface 116 of the housing 1 with the fixing plate 311 resting within the shallow area 114. The lances 3111 are adapted to engage with corresponding grounding parts of the complementary connector.

In a semi-assembled condition (FIG. 4), a gap is defined between the pressing plate 33 and the first terminal strips 21 for extension of a FPC 4. The fixing recesses 130 of the housing 1 engage with the first tangs 360, which prevents a disengagement of the housing 1 relative to the shield 3.

Also referring to FIGS. 4 and 5, the FPC 4 is inserted into the electrical connector from a rear side thereof. A leading edge of the FPC 4 extends through the gap. The tabs 331 of the shield 3 properly guide the insertion of the FPC 4 to prevent a lateral shift of the flexible cable 4. The leading edge of the FPC 4 includes a grounding pattern on a face-down side thereof facing the pressing plate 33 and a signal pattern on an opposite side thereof facing the first terminal strips 21. The shield 3 is further pushed forwardly from the semi-assembled condition of FIG. 4 to a finally assembled condition of FIG. 5.

In this finally-assembled condition (FIG. 5), the bosses 332 of the pressing plate 33 contact the grounding pattern of the FPC 4 and the first signal strips 21 contact the signal pattern of the FPC 4. The fixing recesses 130 of the housing 1 engage with the second tangs 361 of the shield 3 and prevent the housing 1 from disengagement from the shield 3. Therefore, the housing 1 is permanently retained within the shield 3.

In this embodiment, a mating header connector (not shown) includes a plurality of contacts adapted to be inserted into the electrical connector from the front surface 110 to engage the terminals 2. The mating header connector connects a PCB (Printed Circuit Board). Thus, a signal path between the PCB and the FPC 4 is established.

When the semi-assembled electrical connector is required to be transported, the shield 3 is fixed to the housing 1 by an engagement between the first tangs 360 and the fixing recesses 130. Thus, the shield 3 is fixed in position, without the fear that it will move to collide with other parts of the connector or with other random objects during the transportation, thereby avoiding a common source of damage to the conventional connector. Furthermore, the connector of the present invention has a reduced number of components (i.e., only one shield being needed) and a simple structure, thereby making its manufacture time and cost efficient and facilitating automatic manufacture.

It should be noted that the titles of the top surface and the bottom surface of the housing and the top wall and the bottom wall of the shield are called according to the views thereof in the drawings. However, while the top surface and the top wall may used as a "bottom" surface and the "bottom" wall, the bottom surface and the bottom wall may used as a "top" surface and a "top" wall in a different embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flexible cable electrical connector for use with a flat cable, comprising:

an insulative housing defining a plurality of passageways and a slot at a rear end thereof in communication with the passageways;

a plurality of terminals retained in the passageways; and a conductive shield slidably covering the housing and including an integral pressing plate, the pressing plate extending into the slot;

wherein in a provisionally-retained condition where the housing is provisionally retained by the shield a gap is defined between the pressing plate and the terminals for insertion of the flexible cable, and in a fully-retained condition where the housing is fully retained by the shield, the pressing plate further moves into the slot to be in contact with the inserted flexible cable and press the flexible cable into contact with the terminals;

wherein a plurality of bosses are formed in the pressing plate and are adapted to contact the flexible cable;

wherein a pair of tabs upwardly extend from opposite ends of the pressing plate to properly position the flexible cable and prevent transverse movement of the flexible cable;

wherein a pair of beams are formed at opposite ends of the housing, each beam forming a fixing recess, and the shield includes a pair of lateral walls to cover the opposite ends of the housing, each lateral wall forming a pair of inwardly stamped tangs for engaging with the fixing recess in the provisional-retained condition and the full-retained condition, respectively.

* * * * *